United States Patent [19]

Cole

[11] 4,217,741

[45] Aug. 19, 1980

[54] METAL ROOF PANEL STRUCTURE

[76] Inventor: Randall L. Cole, P.O. Box 74, Tell City, Ind. 47586

[21] Appl. No.: 941,384

[22] Filed: Sep. 12, 1978

[51] Int. Cl.[2] ..... E04D 1/06

[52] U.S. Cl. ..... 52/520; 52/537; 52/543

[58] Field of Search ..... 52/520, 521, 528, 543, 52/394, 518, 537

[56] References Cited

U.S. PATENT DOCUMENTS

| | | | |
|---|---|---|---|
| 277,254 | 5/1883 | Fitzberger et al. | 52/528 |
| 426,627 | 4/1890 | Sagendorph | 52/394 |
| 938,869 | 11/1909 | Hunter | 52/394 |

FOREIGN PATENT DOCUMENTS

| | | | |
|---|---|---|---|
| 1237309 | 6/1960 | France | 52/521 |
| 984136 | 2/1965 | United Kingdom | 52/520 |

*Primary Examiner*—James L. Ridgill, Jr.
*Attorney, Agent, or Firm*—Warren D. Flackbert

[57] ABSTRACT

A metal roof panel structure characterized by roof panels interconnected by a metal roof clip which extends between the juncture of contiguous roof panels and an upwardly projecting reinforcing portion disposed in the mid-area of each roof panel. Strength is further afforded by the crimping of the connected ends of the roof panels and the reinforcing portion on each roof panel and, additionally, a sealant is provided for weatherproofing purposes.

4 Claims, 3 Drawing Figures

METAL ROOF PANEL STRUCTURE

As is known, the usage of metal buildings is widespread, such representing ease in installation, a pleasing appearance and durability. A problem has been presented, however, in the assembly of the roof panels for the metal buildings because of the mostly complicated and time consuming seaming procedures now in use. In this connection, the currently marketed approaches limit the width of the individual panel.

The invention provides an important contribution to the metal roofing industry by permitting the use of panel sections which are considerably wider than those in present use. In order to employ such wider roof panels, a metal roof clip is provided which extends from the juncture of contiguous roof panels to an upwardly projecting portion which serves to reinforce the center of each panel. A crimping operation stabilizes and strengthens the assembled panels, including both ends of the roof clip. Additionally, a sealant is provided for purposes of weatherproofing.

Figure 1:
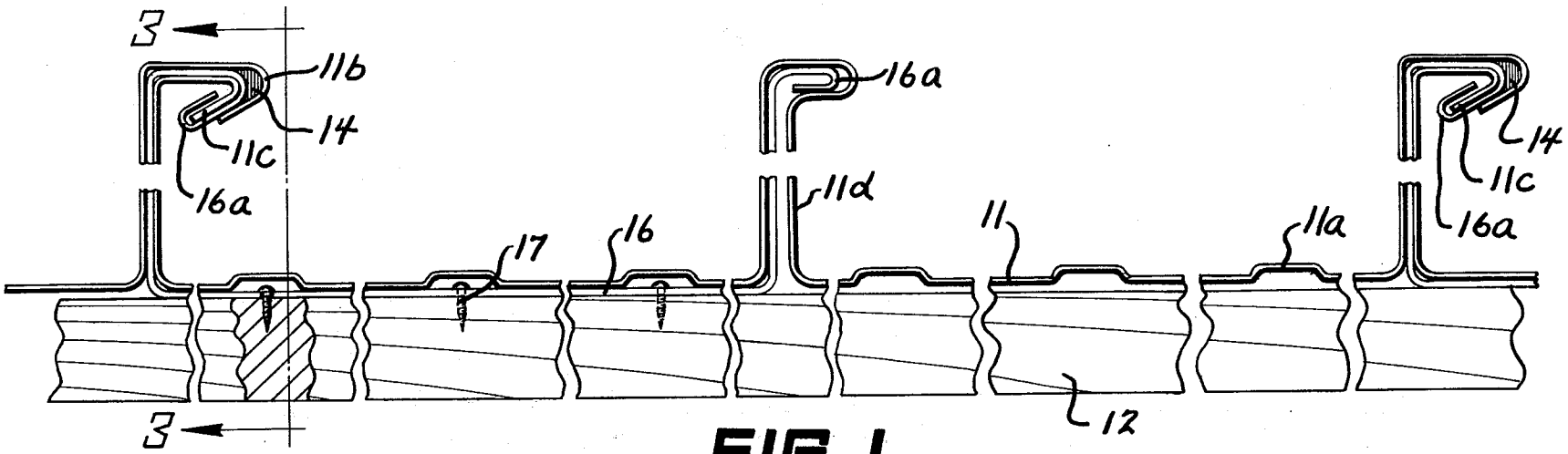
Figure 2:
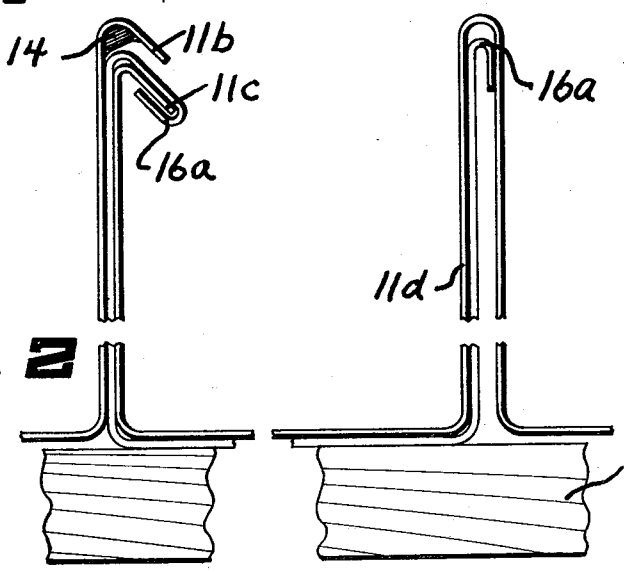
Figure 3:
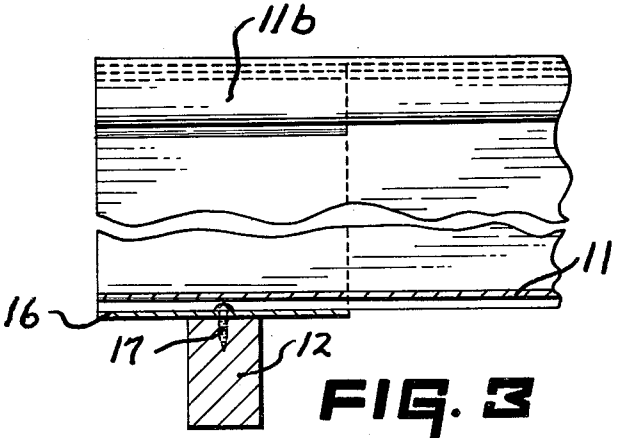

A better understanding of the present invention will become more apparent from the following description, taken in conjunction with the accompanying drawing, wherein FIG. 1 is a view in elevation, partly fragmentary and partly in section, showing a metal roof panel structure in accordance with the teachings of the present invention;

FIG. 2 is another view in elevation, but in this instance showing the arrangement prior to the final assembly as in FIG. 1; and, FIG. 3 is a view in vertical section, taken at line 3—3 on FIG. 1 and looking in the direction of the arrows, illustrating other details of the invention.

For the purposes of promoting an understanding of the principles of the invention, reference will now be made of the embodiment illustrated in the drawing and specific language will be used to describe the same. It will nevertheless be understood that no limitation of the scope of the invention is thereby intended, such alterations and further modifications of the illustrated device and such further applications of the principles of the invention as illustrated therein being contemplated as would normally occur to one skilled in the art to which the invention relates.

Referring now to the figures, the metal roof structure of the invention is defined by a series of panels 11 supported by trusses 12 for the roof. Typically, the panels 11 are formed from flat roll stock steel or aluminum. As will be particularly evident in FIG. 1, a series of corrugations 11*a* extend along the length of each panel 11. An important feature of the invention, to be discussed more fully herebelow, is that the width of each panel 11 can be much greater than those in current use, i.e. for example, up to 36", in contrast to 16" or 24".

In any event, a series of panels 11 is placed on the trusses 12 in a contiguous relationship. Each panel 11 includes a raised end portion 11*b* and 11*c*, where a difference in configuration, evident in the left hand portion of FIG. 2, is provided to permit overlapping with an adjacent panel 11. The end portion 11*b* of panel 11 extends upwardly and bends outwardly and downwardly and contains any desired weather sealant 14. On the other hand, the end portion 11*c* of the panel 11 extends upwardly and bends inwardly and downwardly. An upstanding projecting portion 11*d* is disposed in the mid-area of each panel 11, serving purposes of reinforcement upon assembly.

A roof clip 16 is provided for installation purposes, being defined by turned back ends 16*a* (again see FIG. 2). The roof clip 16 is secured, as by threaded fastening means 17, to the truss 12 (see FIGS. 1 and 3).

During installation, the roof clips 16 are fastened onto the trusses 12, and the seam assembly includes end portion 11*b* overlapping the turned back end 16*a* of roof clip 16, which, in turn, overlaps end portion 11*c*, all at the juncture of adjacent panels 11 along the roofed area. The opposite end of the roof clip 16 extends into the upstanding projecting portion 11*d* in the mid-area of each panel 11. In other words, with such an arrangement, the roof clip 16 serves reinforcement purposes for the center of the wider panel afforded by the invention.

Thereafter, by use of a crimping mechanism (not shown), a seam or joint such as that shown in FIG. 1 is achieved. Typically, the crimping is accomplished in two stages, i.e. at 45° and then 90° to the vertical. The use of sealant 14 assures weather tightness at the seams.

From the preceding, it should be apparent that the invention affords the ready assembly of metal roof panels having greater width than those presently used. The roof clip 16 of the invention affords important intermediate support of the wider panel 11. Positive assembly and sealing of the seams is achieved by crimping and by the use of a sealant.

The metal roof panel structure described above is susceptible to various changes within the spirit of the invention, as, for example, the type and gauge of the metal, the manner of fastening the roof clip onto a truss, and the like. Thus, the preceding should be considered illustrative and not as limiting the scope of the following claims:

I claim:

1. A metal roof panel structure comprising a first panel, a second panel, and a roof clip interconnecting said first panel and said second panel, said first panel and said second panel each having an end portion extending upwardly, downwardly and outwardly and an opposite end portion extending upwardly, downwardly and inwardly, said first panel and said second panel each having an upwardly extending hollow portion at the mid-area thereof, and said roof clip having one end sandwiched between contiguous end portions of said first panel and said second panel which overlie in the same direction and hooking over the end portion of one of said panels to define a multi-layered overlapping assembled seam and an opposite end which extends into said upwardly extending hollow portion of a panel, where the seam between said first panel and said second panel including said one end of said roof clip is crimped and where said upwardly extending hollow portion of a panel including said opposite end of said roof clip is crimped, all in a watertight relationship.

2. The metal roof panel structure of claim 1 where a sealant is received within the outwardly extending end portion of a panel.

3. The metal roof panel structure of claim 1 where said roof clip is secured to a truss.

4. The metal roof panel structure of claim 1 where said opposite end of said roof clip has a turned back end.

* * * * *